US007762285B2

(12) United States Patent
Drope et al.

(10) Patent No.: US 7,762,285 B2
(45) Date of Patent: Jul. 27, 2010

(54) GLUED HEALD MOUNTING RAIL

(75) Inventors: Stefan Drope, Albstadt (DE); Karl-Heinz Gesing, Raesfeld (DE); Eckhard Fehrenbacher, Tuebingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/232,128

(22) Filed: Sep. 11, 2008

(65) Prior Publication Data

US 2009/0065087 A1 Mar. 12, 2009

(30) Foreign Application Priority Data

Sep. 11, 2007 (EP) ..... 07017730

(51) Int. Cl.

| | |
|---|---|
| ***D03C 9/02*** | (2006.01) |
| ***D03C 9/04*** | (2006.01) |
| ***D03C 9/06*** | (2006.01) |
| *D03C 13/00* | (2006.01) |

(52) U.S. Cl. ..... 139/92; 139/55.1; 139/91

(58) Field of Classification Search ..... 139/55.1, 139/91–96

See application file for complete search history.

(56) References Cited

U.S. PATENT DOCUMENTS

| | | | | |
|---|---|---|---|---|
| 4,390,045 | A * | 6/1983 | Baumann | 139/91 |
| 4,844,130 | A * | 7/1989 | Blontrock | 139/92 |
| 5,183,082 | A * | 2/1993 | Baumann | 139/92 |
| 5,232,025 | A * | 8/1993 | Gysin et al. | 139/92 |
| 6,283,163 | B1 * | 9/2001 | Kagi | 139/93 |
| 2002/0124902 | A1 * | 9/2002 | Magri et al. | 139/92 |
| 2005/0016612 | A1 * | 1/2005 | Manthey et al. | 139/93 |
| 2005/0051228 | A1 * | 3/2005 | Bruske et al. | 139/55.1 |
| 2005/0061385 | A1 * | 3/2005 | Gesing | 139/91 |
| 2005/0081941 | A1 * | 4/2005 | Schmid et al. | 139/91 |
| 2005/0081943 | A1 * | 4/2005 | Olbing et al. | 139/92 |
| 2005/0109417 | A1 * | 5/2005 | Gesing | 139/55.1 |
| 2006/0249218 | A1 * | 11/2006 | Mettler | 139/79 |

FOREIGN PATENT DOCUMENTS

| | | |
|---|---|---|
| DE | 102004037717 | 12/2005 |
| EP | 0 504 102 | 9/1992 |
| EP | 1 170 409 | 1/2002 |
| JP | 59-149981 | 10/1984 |

* cited by examiner

*Primary Examiner*—Bobby H Muromoto, Jr.
(74) *Attorney, Agent, or Firm*—Fitch, Even, Tabin & Flannery; Norman N. Kunitz

(57) ABSTRACT

A shaft rod (1) having a heald mounting rail (3) glued to the rod body (2) using a space-filling adhesive (19) provided in an accommodation space (14) on the mounting rail (3) or the rod body (2) and having a greater volume than a holding section (10) formed on the rod body (2) or the mounting rail (3). Preferably, the holding section (10) and the accommodation space (14) are configured such that the two parts can only be inserted into each other with a pivoting movement. To achieve this, the holding section (10) preferably has a part (21) extending transverse to the mouth (17) of the accommodation space (14), and being wider than the mouth (17), thus extending behind a wall section or part (31, 34) of the accommodation space (14). Preferably, the accommodation space (14) and the holding section (10) are configured as hook profiles that engage each other.

16 Claims, 3 Drawing Sheets

GLUED HEALD MOUNTING RAIL

CROSS REFERENCE TO RELATED APPLICATION

The present application claims the priority of European Patent Application No. 07 017 730.8, filed Sep. 11, 2007, the subject matter of which, in its entirety, is incorporated herein by reference.

BACKGROUND OF THE INVENTION

The invention relates to a shaft rod for setting up a heald shaft for a weaving machine.

Heald shafts in weaving machines are disposed to accommodate a large number of healds, whereby each heald has a thread eye in order to guide a warp thread. Additional warp threads run between the healds. As a result of the up-and-down movement of the heald shaft the warp threads guided by the healds can be moved out of the plane of the remaining healds, as a result of which a shed is created into which the weft thread can be carried.

In most cases, each heald has at least two horizontal shaft rods that are parallel to each other and that have ends that are connected to each other by vertical lateral supports. Thus, the heald shaft forms a rectangular frame. Each of the upper and the lower shaft rods carries a heald mounting rail that consists, e.g., of steel. The healds have terminal eyelets that are used to hold them on the heald mounting rails.

In most cases, the heald shafts and the heald mounting rails are manufactured separately and subsequently connected to each other. To accomplish this, document DE 10 2004 037 717 B3 suggests the use of rubber cords. To do so, the shaft rod is provided with a groove that extends into a foot of the heald mounting rail. The rubber cord that is inserted in axially expanded state into the remaining space is used for clamping the foot in place in the groove. If the rubber cord is relaxed, it is shortened and its diameter is thus increased, so that it wedges the foot of the heald mounting rail into the groove of the shaft rod. However, to do so, it is necessary that the rubber cord be able to contract accordingly along the entire length. In addition, the heald mounting rail is provided with a relatively complexly formed, precisely fitting foot in order to effect a correct positioning of the rails and also a positive-locking engagement for securing said rail.

Document JP 59-149981 discloses a heald mounting rail that has a trapezoidal foot. Depending on the embodiment, this foot is manufactured separately and riveted to the heald mounting rail or made in one piece with said heald mounting rail. The shaft rod comprises an appropriately shaped accommodation space into which the mounting rail foot is inserted and secured, for example, by gluing, so that a thin glued joint is formed.

This type of connecting technique requires that the parts to be connected to each other display narrow tolerance ranges.

Considering this, it is the object of the invention to provide a possibility for the manufacture of shaft rods for healds by means of a reliable process.

SUMMARY OF THE INVENTION

The above object is generally achieved with a shaft rod in accordance with the invention comprising a rod body and a heald mounting rail that are glued to each other. Gluing occurs within an accommodation space in which a holding section as well as a space-filling, solidifying material, e.g., in the form of an adhesive, are provided. The heald mounting rail is configured as a bent sheet metal part having at least one bent edge. The concept "bent sheet metal part" is also understood to mean roll-formed sheet metal parts. They consist of sheet metal having preferably uniform thickness.

These measures permit a particularly simple and reliable process for the manufacture of the shaft rod. The space-filling adhesive fills the accommodation space at least in so far as the holding section extends into said space. Preferably, the space-filling adhesive fills the larger portion of the accommodation space while the holding section fills the smaller portion of the accommodation space. In other words: the holding section extends with significant play into the accommodation space, so that said holding section can always be easily inserted into the accommodation space, irrespective of the manufacturing tolerances. To achieve this, the accommodation space has, in the region of its mouth, a width of cross-section—in opening direction, as well as in transverse direction of the mouth—that is greater than the material thickness of the holding section. The space-filling adhesive compensates for manufacturing tolerances and secures the holding section positively bonded in the accommodation space. This results in a cost-effective connection.

The holding section and the accommodation space are in engagement with each other. As a result of the shape of the regions that are in engagement with each other, additional connecting means such as, e.g., rivets or screws, become unnecessary. The connection is combined—positively bonded and positively connected—i.e., it is partially due to the material bond between the accommodation space, the holding section and the adhesive and partially due to the shape of the involved parts that are in abutment with each other in at least one area, preferably on at least two surfaces.

The holding section is preferable a part of the heald mounting rail, however, may also be part of the rod body. Preferably, it is configured as a foot displaying uniform material thickness. Preferably, the holding section is part of a bent sheet metal part which represents the heald mounting rail or also the rod body. In order to anchor the holding section in the accommodation space, said section—in connected state—is angled in an area located in the accommodation space. This improves anchoring of the holding section in the accommodation space.

The accommodation space is preferably provided on the rod body. To do so, the rod body may also be configured as an extrusion-molded aluminum profile. It may also comprise a bent sheet metal part or several components that are connected to each other by welding, gluing or other connecting techniques. The arrangement of the accommodation space on the rod body results in simple engineering designs of the heald mounting rail that can then be configured as a bent sheet metal part in a particularly simple manner. Preferably, the height/width ratio is <5. As a result of this, a compact, stiff mounting rail is produced. In addition to the at least one bent edge, the mounting rail may have additional bent edges, thus resulting in a stable, strong mounting rail. The bent edges are disposed to stiffen the sheet metal strip that constitutes the mounting rail.

For mounting, the heald mounting rail and the rod body are preferably turned into each other, i.e., the holding section is pivoted into the accommodation space. The angled foot section preferably has a greater width than the mouth of the accommodation space. Therefore, when pivoted in, the foot section extends around a wall of the accommodation space, thus effecting a positive-locking secure retention.

Due to the pivoting or rotating movements of the rod body and the heald mounting rail toward each other, assembly of a long mounting rail of a shaft rod having a length of 4 to 6 meters, for example, is facilitated. The space-filling adhesive can be introduced in the accommodation space before joining the mounting rail and the rod body. After the mounting rail has been pivoted in, the adhesive flows around the holding section thus fixing said section in place. Depending on the composition of the adhesive, it is also possible to introduce it into the accommodation space following the assembly, i.e., after pivoting the mounting rail into the accommodation space of the rod body. A preferably thinly liquid adhesive then fills the accommodation space almost completely. After pivoting-in the mounting rail, preferably at least two surfaces of the connecting section that are at an angle relative to each other abut against the surfaces of the accommodation space, so that the heald mounting rail is fixed in the desired set position when the adhesive hardens. It is also possible to provide stop means on the connecting device, said means resulting in a stop effect and temporarily securing the heald mounting rail. This simplifies the fixation of the heald mounting rail while the adhesive is hardening.

The accommodation space may be arranged on the heald mounting rail as well as on the rod body. In the latter case, said space if preferably provided on a flat side thereof. However, said space may also be provided on a narrow side, should this be desirable. Preferably, the accommodation space has a mouth that opens parallel or perpendicular to a flat side of the heald mounting rail. Preferably, a pan-shaped region is provided underneath the mouth, said region representing the accommodation space and permitting the introduction of larger quantities of adhesive, before the heald mounting rail is connected to the rod body.

Additional details of advantageous embodiments of the invention are the subject matter of the drawing, the description or the claims. The description is restricted to essential aspects of the invention and miscellaneous situations. The drawings disclose additional details and are to be referred to as supplementary.

DETAILED DESCRIPTION OF THE INVENTION

Figure 1:
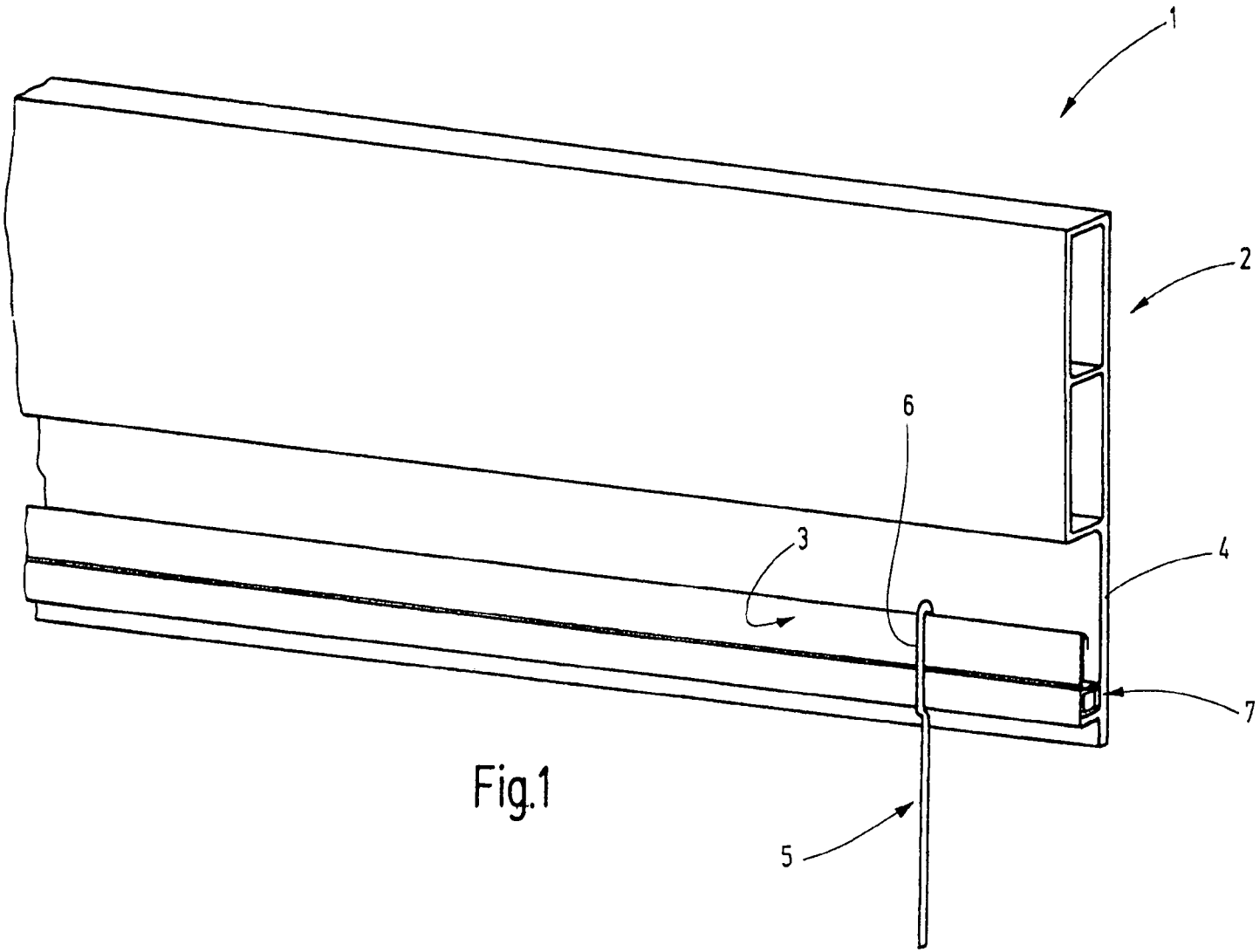
FIG. 1 is a simplified perspective view of a shaft rod.

FIG. 1 shows a shaft rod 1 of a heald shaft. The shaft rod 1 comprises a rod body 2 and a heald mounting rail 3 that are connected to each other. The rod body 2 may extend over a length of several meters. It provides the necessary vertical stiffness of the shaft rod 1. Preferably, as shown, it consists of an extrusion-molded aluminum profile that has one or more chambers in the form of cavities. The rod body 2 has a strip section 4 that extends vertically away from the chamber profile and is supported on the heald mounting rail 3. However, alternatively, the rod body 2 may be a differently configured body. For example, it may be constructed of one or more parts that are connected to each other by appropriate connecting techniques such as gluing, welding and the like. Thus, said body may be assembled of sheet metal parts consisting of non-ferrous metals, of plastic parts and similar elements.

The heald mounting rail 3 is preferably a bent sheet metal part. It is used for the support of healds, one of said healds 5 being shown in FIG. 1 as being representative of a large number of healds that are respectively held by their end eyelets 6 on the heald mounting rail 3.

The heald mounting rail 3 is connected to the rod body 2 by a connecting device 7.

Figure 2A:
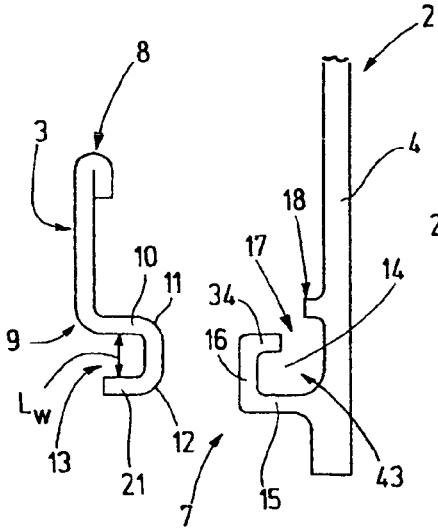
FIGS. 2*a* through 2*c* are an illustration of details of the principle of the rod body and the heald mounting rail of the shaft rod in accordance with FIG. 1, before and after the connection.
Figure 2B:
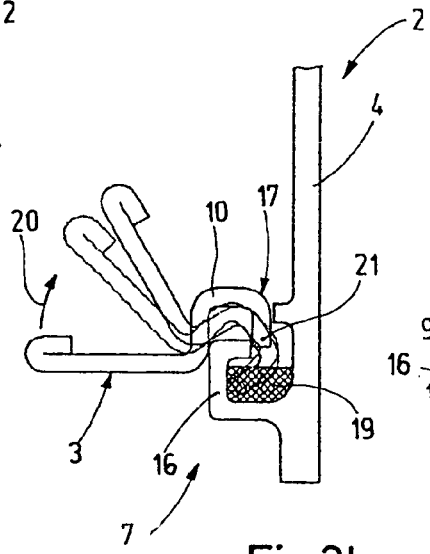
Figure 2C:
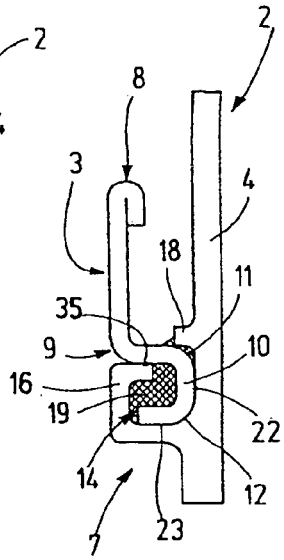

For further illustration of the connecting device 7 in particular, reference is made to FIGS. 2*a* through 2*c*. The heald mounting rail 3, as a bent sheet metal part, has an essentially uniform sheet metal thickness, i.e., material thickness. It has a bent edge 8 on its upper end in order to thus form a rounded support surface for the end eyelet 6 of the heald 5. Starting from the bent edge 8, a longer leg extends up to another bent edge 9, at which the heald mounting rail 3 preferably is bent at a right angle. Beginning at the bent edge 9 is a holding section 10 for fastening the heald mounting rail 3 to the rod body 2. In the present exemplary embodiment, the holding section 10 is represented by a hook-shaped section having two bent edges 11, 12 and an inside width Lw. Consequently, the holding section 10 defines a hook profile 13 having a U-shaped cross-section.

Furthermore, the connecting device 7 comprises an accommodation space 14 that is bordered by a wall section 15 projecting from the strip 4. The wall section 15 first extends approximately at a right angle toward the strip 4 and then its front wall section 16 extends parallel to the strip 4. The upper edge 34 of the front wall section 16, in turn, is bent inward. Consequently, the front wall section 16 forms a hook profile 43 that is set opposite the hook profile 13 of the holding section 10.

The accommodation space 14 has a slit-shaped mouth 17 that opens in upward direction approximately parallel to the strip 14. A rib 18 may be provided in the immediate vicinity of the mouth 17 at the strip section 4, said rib extending parallel to the mouth 17.

The holding section 10 has a cross-section that is substantially smaller than the total cross-section of the accommodation space 14. Preferably, the ratio of the cross-section of the holding section 10 to the cross-section of the accommodation space is 14 $\leqq$1:2.

The pan-like accommodation space 14 is disposed to receive the space-filling adhesive 19, as is obvious from FIGS. 2*b* and 2*c*.

The connection 7 is preferably achieved as follows:

First, the accommodation space 14, as indicated in FIG. 2*b*, is at least partially filled with adhesive 19 that has not yet fully hardened. Here, the concept "adhesive" is understood to mean any substance that is initially present in liquid, thickly viscous or dough-like kneadable or otherwise easily moldable state and can be hardened, in which case hardening does not reduce or at least not substantially reduce its volume. This means, it remains space-filling. Hardening can be achieved by chemical additives, physical effect such as, e.g., heat, light or the like, or over time. Preferably, the adhesive enters an adhesive bond with surfaces wetted by said adhesive. After hardening and depending on its composition, said adhesive may be rigid or even slightly elastic. In the last-mentioned case, it may be resiliently elastic or it may also display an inherent damping effect that provides, in particular, a damping of vibrations.

Once the moldable adhesive 19 has been introduced into the accommodation space 14, it forms there—as illustrated by FIG. 2*b*—first a surface that is located beneath the mouth 17, preferably beneath the upper edge 34 of the accommodation space 14. Now, the connecting section 10 of the heald mounting rail 3 is attached, at approximately a right angle and extending from the strip section 4, to the front wall section 16 in the position as illustrated in FIG. 2*b*. In so doing, as is obvious, the angled upper edge 34 of the front wall section 16 is preferably slightly shorter than the inside width Lw of the hook profile 13, so that said hook profile can be slid from the top in downward direction over the angled upper edge 34 of the front wall section 16. Then, the heald mounting rail 3 is pivoted as indicated by an arrow 20 in FIG. 2*b*. In so doing, the lower angled edge 21 of the heald mounting rail 3 extends under the upper inward angled edge 34 of the front wall section 16. Finally, the heald mounting rail 3 is pivoted into its position in accordance with FIG. 2*c*, in which it extends essentially parallel to the strip section 4. In so doing, at least two of its outside surfaces of its connecting section 10 abut against the corresponding inside surfaces of the accommodation space 14. The corresponding planar abutments are identified with 22 and 23 in FIG. 2*c*. In addition, the bent edge 11 is located preferably under the rib 18, while the heald mounting rail 3, if necessary, may be seated on the inward-bent upper edge 34 of the front wall section 16. Then it is also possible for two surfaces to abut against each other, in which case an inside surface of the connecting section 10 abuts against an outside surface of the upper edge 34 of the front wall section 16. This results in the planar abutment 35.

By turning the holding section 10 into the accommodation space 14, part of the adhesive 19 is displaced out of the accommodation space 14. This adhesive flows around the holding section 10 and, for example, stays between the rib 18 and the heald mounting rail 3. In this position of the heald mounting rail 3, the space-filling adhesive 19 may finish hardening, thus permanently securing the heald mounting rail 3 to the strip section 4.

Figure 3:
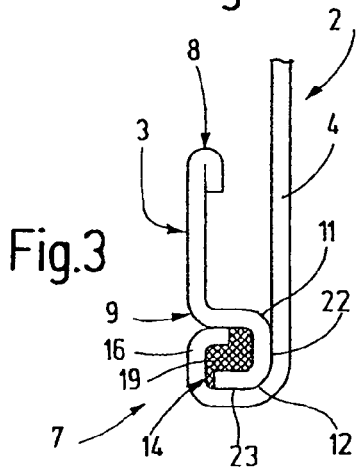
FIG. 3 is a view of a detail of the front of an alternative embodiment of the shaft rod.

The present exemplary embodiment explains the fundamental principles of the invention; however, numerous modifications are possible. For example, the rod body 2 may consist of a bent sheet metal part or may contain such a part, thereby forming the strip section 4, in particular. One applicable example is provided by FIG. 3. In this case, the rib 18 has been omitted, while, otherwise, the above description applies analogously with reference to the same reference numbers.

Figure 4A:
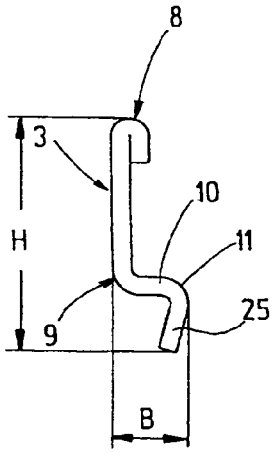
FIGS. 4*a* through 4*d* are details of a schematic front view of an alternative embodiment of the shaft rod, before, during and after the connection of the heald mounting rail and the rod body.

Another modified embodiment is shown by FIGS. 4*a* through 4*d*. FIG. 4*a* shows a heald mounting rail 3 having a holding section 10 that has only one angle. Compared with the exemplary embodiment in accordance with FIGS. 2 and 3, the bent edge 12 is missing. The ratio of the height H noted in FIG. 4*a* to the width B, also noted therein, is 5:1 or less. As a result of this, the heald mounting rail 3 is particularly compact and stiff. Regarding the rod body 2, reference may be made to the rod body in accordance with FIGS. 2*a* through 2*c* or FIG. 3, or the rod body in accordance with FIG. 4*b*. It has, on its side facing away from the front wall section 16, an inclined surface 24 displaying an angular direction oriented parallel to the part 25 of the holding section 10. The part 25 is located at the end of the holding part 10.

Figure 4B:
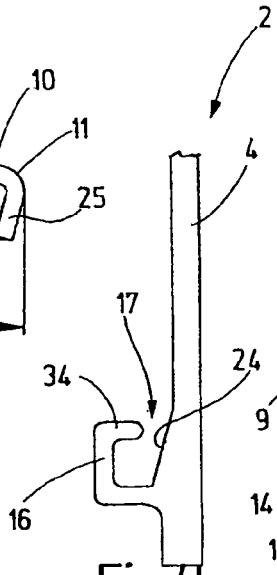
Figure 4C:
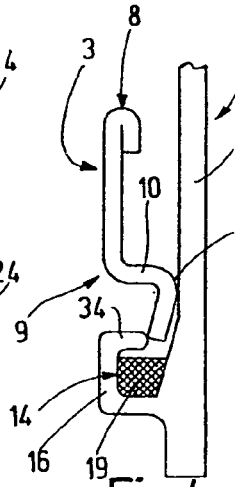
Figure 4D:
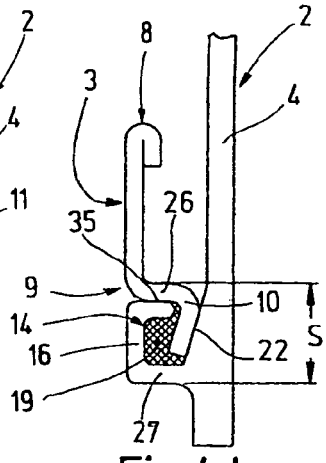

As shown by FIG. 4*c*, this heald mounting rail 3 is inserted into the accommodation space 14 that has been filled with the adhesive 19. A pivoting or rotating movement, as shown by FIG. 2*b*, is not necessary in this case. In this case, the heald mounting rail 3 is fixed to the rod body 2 preferably by positive bonding. Positive locking, in particular in vertical direction as exists in FIGS. 2 and 3 does not exist here. However, the advantage is a particularly low design height. For example, the distance S between the upper part 26 of the holding section 10 and the lower part 27 of the front wall section 16 may be smaller than 4 mm, as is illustrated by FIG. 4*d*. Other than that, the previous description applies analogously with reference to the already introduced reference numbers. If the heald mounting rail 3 is connected to the rod body 2 in accordance with FIG. 4*d*, the alignment of the heald mounting rail relative to the rod body 2 may be achieved by planar abutments 22, 35.

Figure 5A:
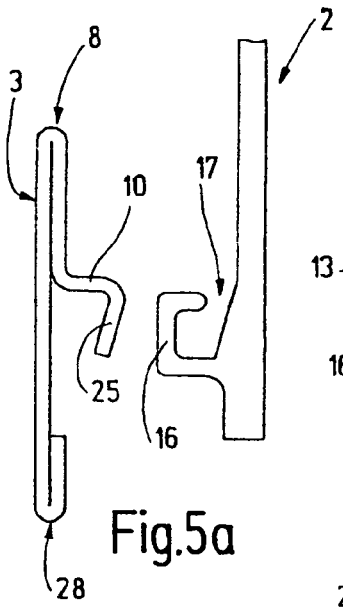
FIGS. 5*a* through 5*c* are details of a schematic front view of an alternative embodiment of the shaft rod, before, during and after the connection of the heald mounting rail and the rod body.
Figure 5B:
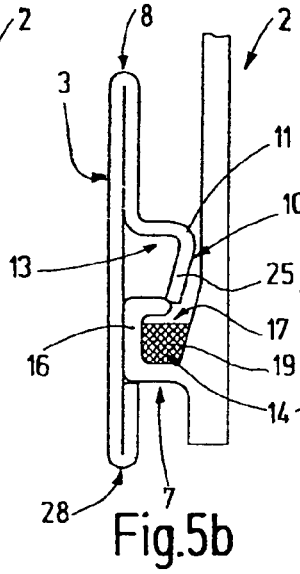
Figure 5C:
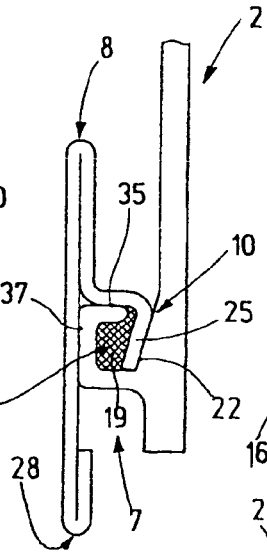

As is shown by FIGS. 5*a* through 5*c*, it is also possible to use a heald mounting rail 3 that has, on its upper side, the bent edge 8 as well as, on its lower side, another bent edge 28, when the rod body 2 in accordance with FIG. 4*b* is used. Again, the heald mounting rail 3 is designed as a bent sheet metal part, for example having the form of a rolled steel profile or of a roll-formed profile. One leg extending away from the bent edge 8 is configured as a holding section 10 on it outer end. As shown by FIG. 5*a*, this section may have the form that has already been shown by FIG. 4*a* and has been described, or may alternatively also have the form as shown by FIG. 2*a*. As shown by FIG. 5*b*, the heald mounting rail 3 for connection with the rod body 2 is first attached to the mouth 17 of the accommodation space 14 in such a manner that the rear side 37 of the front wall of the heald mounting rail 3 abuts in a planar manner against the front wall section 16. The lower edge of the part 25 of the holding section 10, in so doing, abuts against the inward-directed upper edge 34 of the front wall section 16. The heald mounting rail 3 needs to slightly deform in an elastic manner when it is pushed in downward direction. This creates an engagement effect that causes the part 25 to snap over the inward-facing upper edge 34 of the front wall section 16. In so doing, the heald mounting rail 3 is at first temporarily secured against the rod body 2. The part 25 of the holding section 10 penetrating the accommodation space 14 displaces a portion of the adhesive 19. As is the case in all the other exemplary embodiments, the accommodation space 14 is thus filled with the adhesive 19, without any gaps occurring. This state is shown by FIG. 5*c*. Next to the planar abutments 22, 35, another planar abutment 36 may be created in that the rear side 37 of the front wall of the heald mounting rail abuts against the outside of the front wall section 16.

Figure 6:
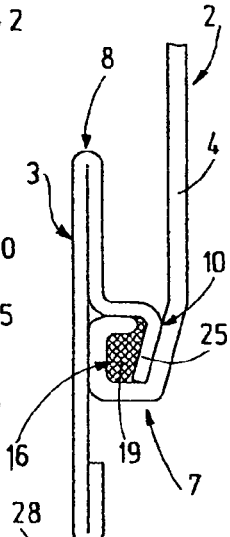
FIG. 6 is a modified embodiment of the shaft rod in accordance with FIG. 5*c*.

As is shown by FIG. 6, it is also possible to apply the principle illustrated by FIGS. 5*a* through 5*c* to the shaft rods 1, these having rod bodies 2 consisting of a sheet metal part. The above description applies analogously with reference to the already introduced reference numbers.

Figure 7A:
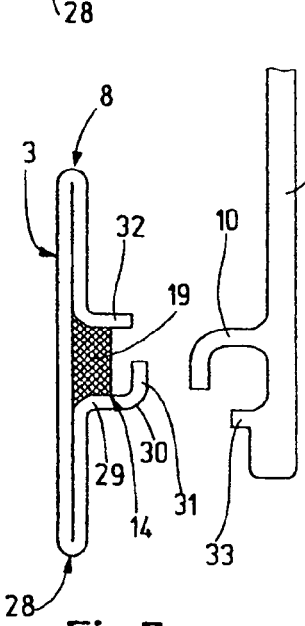
FIGS. 7*a* through 7*c* are details of a schematic front view of a modified embodiment of the shaft rod, before, during and after the connection of the heald mounting rail and the shaft rod.
Figure 7B:
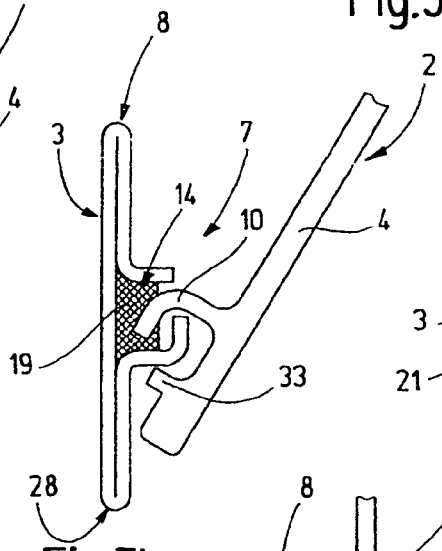
Figure 7C:
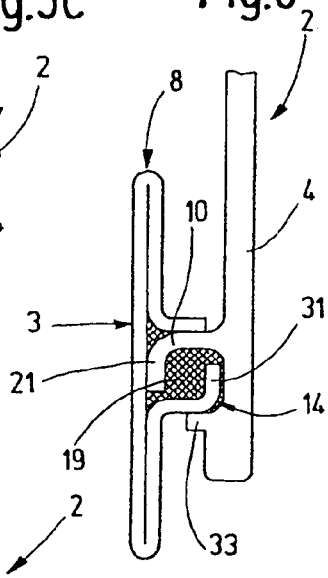

A further modified embodiment is shown by FIGS. 7*a* through 7*c*. It is based on the arrangement of the accommodation space 14 on the heald mounting rail 3 that is configured as a bent sheet metal part. The holding section 10 is configured as a ledge having a hook-shaped cross-section on the strip section 4 and is thus formed to the rod body 2. In order to define the accommodation space 14, the rear leg of the heald mounting rail 3 extending from the lower bent edge 28 in the direction toward the strip section 4 is cranked at two parallel bent edges 29, 30, so that a part 31 parallel to the remaining heald mounting rail 3 delimits the mouth 17 with another part 32. The other part 32 is formed by an edge of a leg of the heald mounting rail 3, said edge being bent toward the strip section 4 and said leg extending away from the upper bent edge 8 in downward direction. The mouth 17 extends approximately perpendicularly toward the strip section 4.

The holding section 10 on the strip section 4 is configured as a ledge having a hook-shaped cross-section, whereby said holding section may be associated with a rib 33 extending parallel at a distance, if needed.

Figure 8:
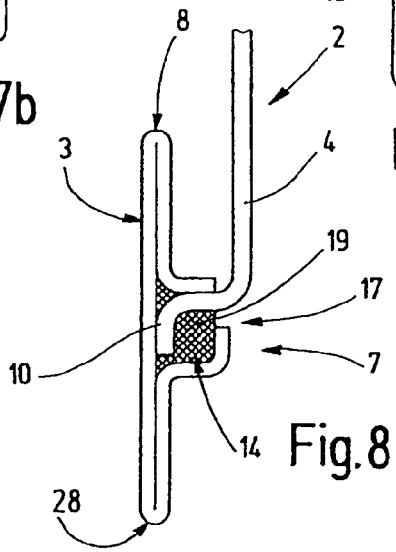
FIG. 8 is a modified embodiment of the shaft rod in accordance with FIG. 7*c*.

The rod body 2 and the heald mounting rail 3 are joined as is obvious from FIGS. 7*b* through 7*c*. First, the adhesive 19 is introduced into the accommodation space 14. Then, the heald mounting rail 3 and the rod body 2 are hooked into each other and pivoted toward each other until the state in accordance with FIG. 7*c* is reached. Again, the adhesive 19 fills all cavities and intermediate spaces without gaps. This principle can be applied even if the strip section 4 of the rod body 2 is formed by a bent sheet metal part as shown by FIG. 8. Also in this case, the above description applies analogously with reference to the previously introduced reference numbers.

Suggested here is a shaft rod 1 comprising a heald mounting rail 3 that is glued to the rod body 2. In order to achieve bonding, a space-filling adhesive 19 provided in an accommodation space 14 of the heald mounting rail 3 or of the rod body 2 is used. The accommodation space 14 has a greater volume than a holding section 10 formed on the rod body 2 or on the heald mounting rail 3. Preferably, the holding section 10 and the accommodation space 14 are configured in such a manner that the two parts can only be inserted into each other with the aid of a pivoting movement. To achieve this, the holding section 10 is preferably provided with a part 21 extending in a direction transverse to the mouth 17 of the accommodation space 14, said part being wider than the mouth 17 and thus extending behind a wall section or a part 31, 34 of the accommodation space 14. Preferably, the accommodation space 14 and the holding section 10 are configured as hook profiles that are in engagement with each other.

It will be appreciated that the above description of the present invention is susceptible to various modifications, changes and modifications, and the same are intended to be comprehended within the meaning and range of equivalents of the appended claims.

REFERENCE NUMBERS

1 Shaft rod
2 Rod body
3 Heald mounting rail
4 Strip section
5 Heald
6 End eyelet
7 Connecting device
8 Bent edge
9 Bent edge
10 Holding section
11, 12 Bent edges
13, 43 Hook profile
14 Accommodation space
15 Wall section
16 Front wall section
17 Mouth
18 Rib
19 Adhesive
20 Arrow
21 Lower edge
22, 23 Abutting surfaces
24 Inclined surface
25, 26, 27 Part
28, 29, 30 Bent edge
31, 32 Part
33 Rib
34 Upper edge
35, 36 Abutting surfaces
37 Rear side
Lw Inside width
H Height of the heald mounting rail
B Width of the heald mounting rail
S Distance

What is claimed is:

1. Shaft rod for a heald shaft, comprising a rod body, a heald mounting rail configured as a bent sheet metal part having a flat side with at least one bent edge for supporting a heald, and means for connecting the rod body and the heald mounting rail together including an accommodation space formed on one of the rod body and the heald mounting rail, a holding section formed on the other of the rod body and the heald mounting rail and extending into the accommodation space, and a space-filling adhesive filling remaining space in the accommodation space and bonding the holding section in the accommodation space, and wherein:

the accommodation space is an elongated trough extending along the length of the shaft rod and having an elongated mouth extending along the length of the rod and through which the holding section extends into an interior of the trough, with the width of the cross-section of the space in the interior of the trough in an opening direction of the mouth as well as in a direction transverse to the opening direction being greater than the material thickness of the holding section, and with the shape of the trough being defined by a plurality of substantially flat walls; and said holding section comprises an arm extending transverse to said flat side of said heald mounting rail when said holding section is bonded in the accommodation space and having at least one bend to form a plurality of flat surface portions, and with at least two of the flat surface portions abutting correspondingly oriented surfaces of the ones of said substantially flat walls defining the shape of the trough to properly position the holding section within the trough, and thus the heald mounting rail on the rod body.

2. Shaft rod in accordance with claim 1, wherein the holding section is part of the heald mounting rail.

3. Shaft rod in accordance with claim 1, wherein the holding section is part of the rod body.

4. Shaft rod in accordance with claim 3, wherein the rod body comprises a bent sheet metal part.

5. Shaft rod in accordance with claim 1, wherein the rod body is an extrusion-molded aluminum part.

6. Shaft rod in accordance with claim 1, wherein the accommodation space is formed on the rod body.

7. Shaft rod in accordance with claim 1, wherein the accommodation space is provided on the heald mounting rail.

8. Shaft rod in accordance with claim 1, wherein the accommodation space mouth is narrower than a part of the holding section, said part being disposed in the accommodation space and extending in a direction transverse to the mouth.

9. Shaft rod in accordance with claim 1, wherein the cross-sectional area of the accommodation space is at least twice as large as the cross-section of the holding section located in the accommodation space.

10. Shaft rod in accordance with claim 1, wherein the mounting rail has a height H and a width B, and the ratio $H/B<5$.

11. Shaft rod in accordance with claim 9, wherein the cross-sectional area of the accommodation space is at least five times as large as the cross-section of the holding section located in the accommodation space.

12. Shaft rod in accordance with claim 1, wherein the accommodation space mouth is oriented parallel to the flat side of the heald mounting rail.

13. Shaft rod in accordance with claim 1, wherein the accommodation space mouth is oriented perpendicular to the flat side of the heald mounting rail.

14. Shaft rod in accordance with claim 1, wherein the heald mounting rail and the rod body are connected to each other in a manner so as to be locked together.

15. Shaft rod in accordance with claim 1, wherein the adhesive is permanently elastic.

16. Shaft rod in accordance with claim 1, wherein the connecting means is configured such that the heald mounting rail and the rod body can be engaged into each other only by a pivoting movement.

* * * * *